US012396599B2

(12) United States Patent
Bai

(10) Patent No.: US 12,396,599 B2
(45) Date of Patent: Aug. 26, 2025

(54) WALL MOUNT DISPENSER

(71) Applicant: Peter Bai, Placentia, CA (US)

(72) Inventor: Peter Bai, Placentia, CA (US)

( * ) Notice: Subject to any disclaimer, the term of this patent is extended or adjusted under 35 U.S.C. 154(b) by 48 days.

(21) Appl. No.: 18/308,515

(22) Filed: Apr. 27, 2023

(65) Prior Publication Data

US 2024/0358201 A1 Oct. 31, 2024

(51) Int. Cl.
*A47K 5/12* (2006.01)

(52) U.S. Cl.
CPC ..... *A47K 5/1217* (2013.01); *A47K 2201/02* (2013.01)

(58) Field of Classification Search
CPC .... A47K 5/1217; A47K 2201/02; A47K 5/16; A47L 13/22; A47L 11/125; A47L 11/4083; B65D 23/003; B65D 47/248; B65D 83/48; B67D 3/043
USPC ..... 222/325, 518
See application file for complete search history.

(56) References Cited

U.S. PATENT DOCUMENTS 6,041,472 A * 3/2000 Kasen ..... B01F 25/105 15/355
9,655,478 B2 * 5/2017 Muderlak ..... A47K 5/1217
2012/0048891 A1 * 3/2012 Hagleitner ..... A47K 5/16 222/138
2019/0374071 A1 * 12/2019 Bai ..... A47K 5/122

* cited by examiner

*Primary Examiner* — Donnell A Long
(74) *Attorney, Agent, or Firm* — Clement Cheng

(57) ABSTRACT

A wall mounted dispenser has a base. A rear mount is formed on the base and the rear mount is configured to attach to a wall. A front cover is configured to fit over the base. The modular socket is formed in the base. The pump housing is configured to fit in the modular socket as a module. The pump is mounted inside the pump housing. A liquid container bracket retains a bracket socket. The liquid container bracket is mounted to the pump housing. A nozzle bracket retains a nozzle. The nozzle bracket is mounted to the pump housing. The nozzle is connected to the pump by an exit tubing. A liquid container removably connects to the bracket socket. Liquid in the liquid container flows through the bracket socket and then to an inlet tubing. The inlet tubing is then connected to the pump.

16 Claims, 7 Drawing Sheets

WALL MOUNT DISPENSER

TECHNICAL FIELD

The present disclosure relates to a wall mount dispenser.

DISCUSSION OF RELATED ART

A variety of bathroom soap wall mount dispensers allow dispensing of liquid cleansers, alcohol such as hand sanitizer, hand soap and body soap. A variety of different United States patents have discussed dispensing, cartridge, for example in U.S. Pat. No. 8,348,105 to Wong, entitled Compact Automatic Homogenized Liquid Detergent Dispensing Device issued Jan. 8, 2003 provides a method for pumping liquid from a soap cartridge.

A counter mount dispensing system is in U.S. Pat. No. 7,752,087 to Rodenbaugh dated Jul. 13, 2010 entitled Product Dispensing System.

The disclosures of the cited references are incorporated herein by reference.

SUMMARY OF THE INVENTION

A wall mounted dispenser has a base. A rear mount is formed on the base and the rear mount is configured to attach to a wall. A front cover is configured to fit over the base. The modular socket is formed in the base. The pump housing is configured to fit in the modular socket as a module. The pump is mounted inside the pump housing. A liquid container bracket retains a bracket socket. The liquid container bracket is mounted to the pump housing. A nozzle bracket retains a nozzle. The nozzle bracket is mounted to the pump housing. The nozzle is connected to the pump by an exit tubing. A liquid container removably connects to the bracket socket. Liquid in the liquid container flows through the bracket socket and then to an inlet tubing. The inlet tubing is then connected to the pump.

The base further includes a cover hinge, wherein the front cover is hinge mounted to the cover hinge, wherein the cover hinge is located at a lower edge of the base, wherein the cover hinge receives the front cover. The modular socket further includes a first socket retainer. The modular socket further includes a second socket retainer. The battery tray opening is formed on the pump housing. A battery tray is mounted to the battery tray opening. A motherboard can receive a controller. The controller is electrically connected to a first sensor and a second sensor. The first sensor and the second sensor comprise a sensor assembly. The sensor assembly is mounted to the nozzle bracket. The sensor assembly is electrically connected to the controller and the sensor triggers operation of the motor.

The modular socket further includes a base clip for retaining the pump housing. The base clip is formed as a leaf spring. The leaf spring has a lower engaging edge that engages the pump housing along an engagement edge. The leaf spring is configured to be snap engaged but then releasable when a user depresses the leaf spring. The base clip formed as a leaf spring is plastic injection molded integrally with the base. The pump is retained to the pump housing when the liquid container is removed.

It is an object of the present invention to provide a liquid dispenser that does not require a pump connected to the liquid cartridge.

The following call out list of elements can be a useful guide in referencing the element numbers of the drawings.

11 Key
12 Key Tooth Insert
13 Key Opening
14 Key Tooth Insert Tip
15 Latch Engagement Surface
16 Modular Socket
17 First Socket Retainer
18 Second Socket Retainer
21 Front Cover
22 Base
23 Window
24 Trim
25 Indicator Lens
26 Front Cover Latch
27 Cover Hinge
28 Rear Mount
29 Liquid Outlet
30 Liquid Container
31 Liquid Container Outlet Opening
32 Liquid Container Bracket
33 Outlet Threads
34 Liquid
35 Hollow Portion
36 Outlet Valve Gate
37 Container Adapter
38 Outlet Valve Gate Spring
39 Outlet Valve Gate Gasket
40 Pump
41 Motor
42 Inlet Pump Nipple
43 Outlet Pump Nipple
44 Bracket Socket
45 Inlet Tubing
46 Exit Tubing
47 Nozzle
48 Motor Electrical
49 Bracket Socket Tube Connector
50 Sensor Assembly
51 First Sensor
52 Second Sensor
53 Sensor Board
55 Nozzle Mount
56 Nozzle Bracket
57 Mother Board
58 Controller
59 Mounting Bracket
60 Pump Housing
61 Pump Housing Base
62 Pump Bracket
63 Pump Housing Cover
64 Battery Tray
65 Battery Tray Opening
66 Indicator Light
67 Control Button
68 Lower Bracket Mount

69 Upper Bracket Mount
70 Valve Gate Pushing Stem
71 Base Retainer
72 Leaf Spring Portion Of Base Retainer
73 Leaf Spring Lower Engaging Edge
74 Leaf Spring Slot

DETAILED DESCRIPTION OF THE EMBODIMENTS

Figure 1:
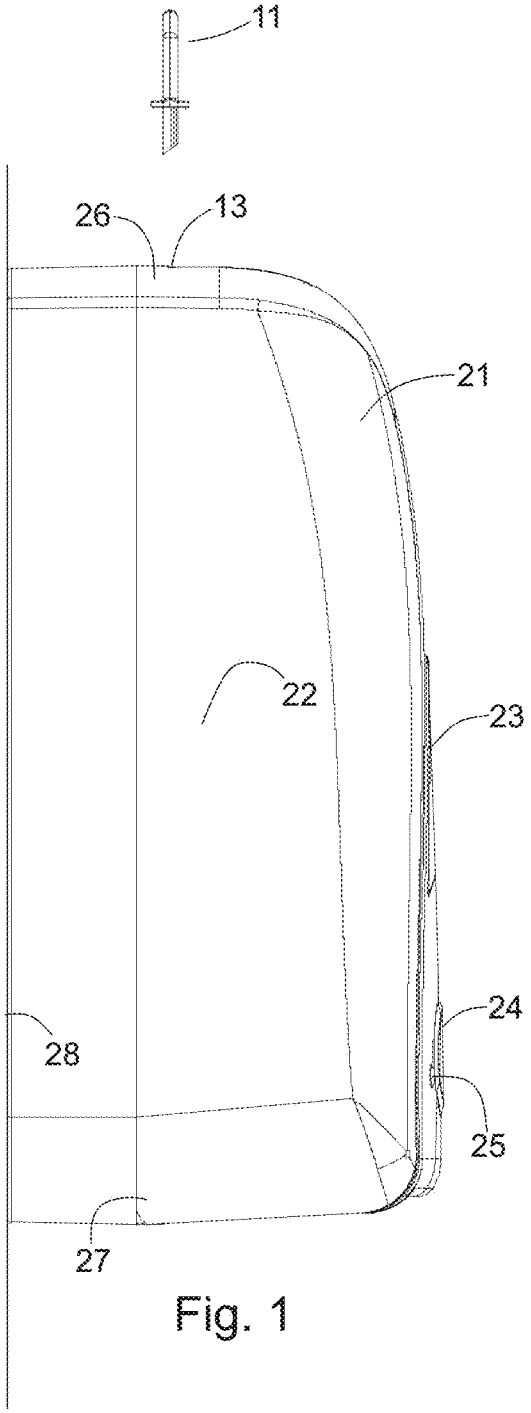
FIG. 1 is a side view of the wall mount dispenser.
Figure 2:
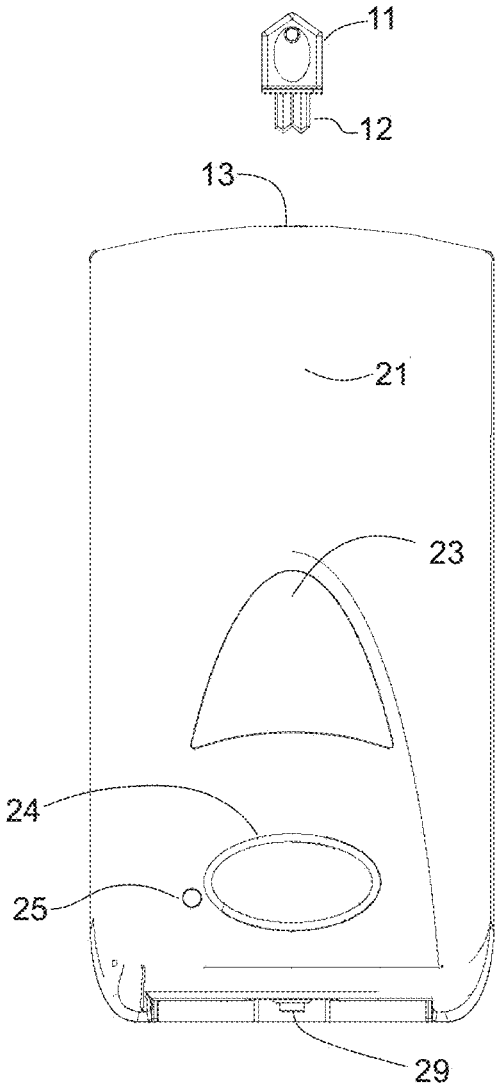
FIG. 2 is a front view of the wall mount dispenser.

As shown in FIGS. 1-2, the side view of the dispenser and a front view of the dispenser show a base 22 having a rear mount 28 connected to a wall. The front cover 11 is connected to the base 22 at a cover hinge 27 which is at a lower edge of the base 22 and the lower edge of the front cover 21. A window 23 is formed on the front cover 21. A trim piece can be mounted to the front cover 21 which can provide a modular oval-shaped indicia that can receive an identifying distributor or source such as a trademark applied to the external surface of the trim piece 24. Adjacent to the trim piece 24, the indicator lens 25 brings light from an LED inside the front cover 21 for providing an indication to a user. A key 11 has a key tooth insert 12 which fits into a key opening 13 that triggers a latch for opening the front cover 21. The liquid outlet 29 which dispenses the soap is located at a lower portion of the front cover 21. The front cover 21 can have an opening at a lower portion which allows the liquid outlet 29 to protrude from the lower portion of the front cover 21.

Figure 3:
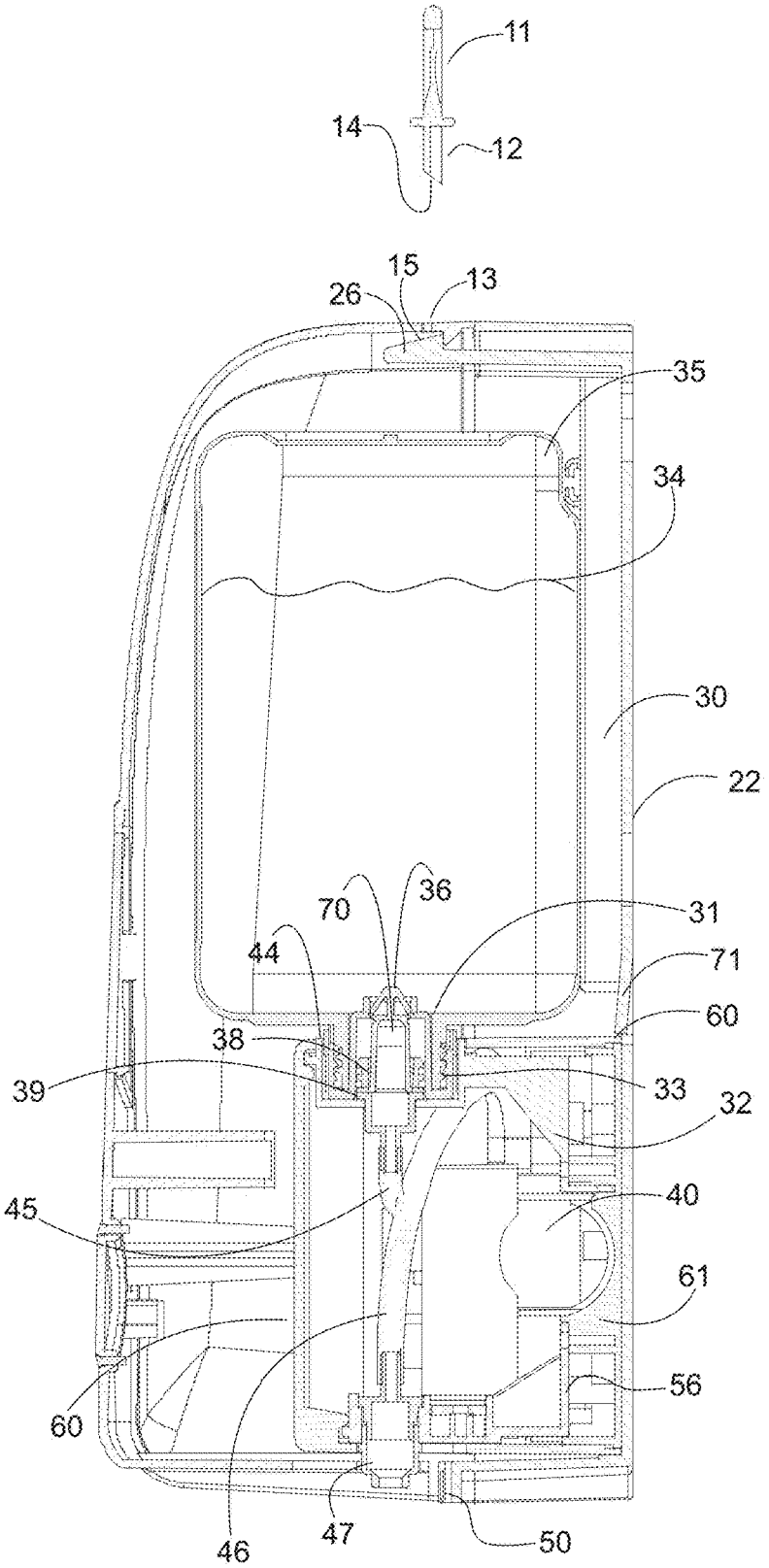
FIG. 3 is a cross-section diagram of the wall mount dispenser.

As seen in FIG. 3, a cross-section of the present invention shows the key 11 with the key tooth insert 12 having a key tooth insert tip 14. The key tooth insert tip 14 is shaped as a pointed and angled tip which engages the front cover latch 26 through the key opening 13. The key tooth insert tip 14 abuts the latch engagement surface 15 formed on the front cover latch 26. The front cover latch 26 is underneath the key opening 13. The front cover latch 26 has a latch angled profile which slopes upwardly from front to back. The key tooth insert tip 14 has a tip angled profile which slopes downwardly from front to back.

A liquid container 30 holds liquid 34 in a hollow portion 35 of the liquid container 30. The liquid container 30 is underneath the front cover latch 26. The liquid container 30 can be a flexible plastic container that fits in the front cover 21. The liquid container 30 has outlet threads 33 that retain an outlet valve gate 36. The outlet valve gate 36 is mounted to the liquid container outlet opening 31 and the outlet valve gate 36 controls liquid 34 flowing through the liquid container outlet opening 31. The outlet valve gate ring 38 biases the outlet valve gate 36 to a closed position when the liquid container 30 is removed from the liquid container bracket 32. The outlet valve gate gasket 39 seals the outlet valve gate 36 against the liquid container outlet opening 31.

The liquid container bracket 32 has a bracket socket 44. The bracket socket receives the liquid container outlet opening 31. The valve gate pushing stem 70 pushes the outlet valve gate 36 into open position and biases against the outlet of valve gate spring 38. The valve gate pushing stem 70 is hollow and connects to the inlet tubing 45. The liquid passes through the valve gate pushing stem 70 and into the inlet tubing 45 after a user loads the liquid container 30 into the liquid container bracket 32. The inlet tubing passes to a pump 40 which then pumps the liquid to an outlet tubing or exit tubing 46. The pump 40 is mounted to a pump housing base 61. The pump housing base 61 has a nozzle bracket 56. The nozzle bracket 56 retains the nozzle 47. Soap or a liquid such as alcohol can be dispensed to the user from the nozzle 47. The pump housing 60 includes the pump housing base 61 and retains the pump 40, liquid container bracket 32, and the nozzle bracket 46. The pump housing 60 modularly attaches to the base 22 at a base retainer 71. The base retainer 71 can be formed as a base clip. The pump housing 60 also has a sensor assembly 50 for sensing the user.

Figure 4:
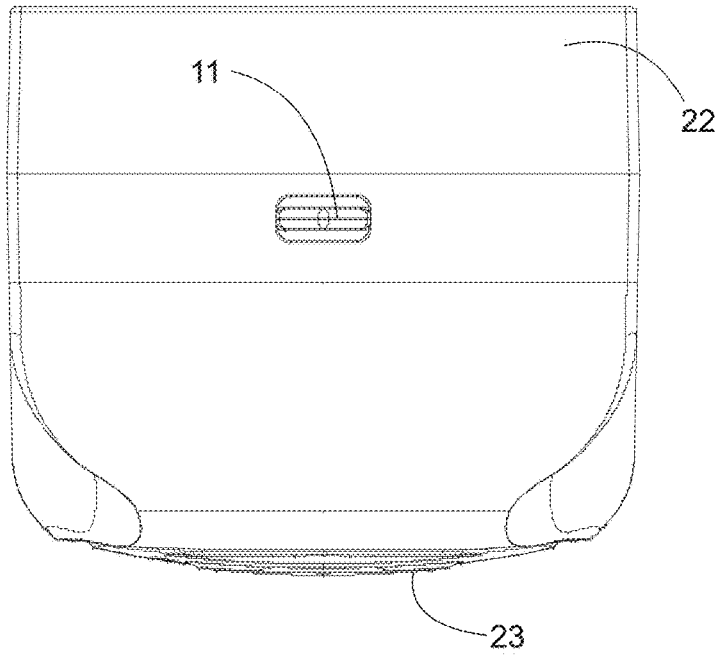
FIG. 4 is a top view of the dispenser.
Figure 5:
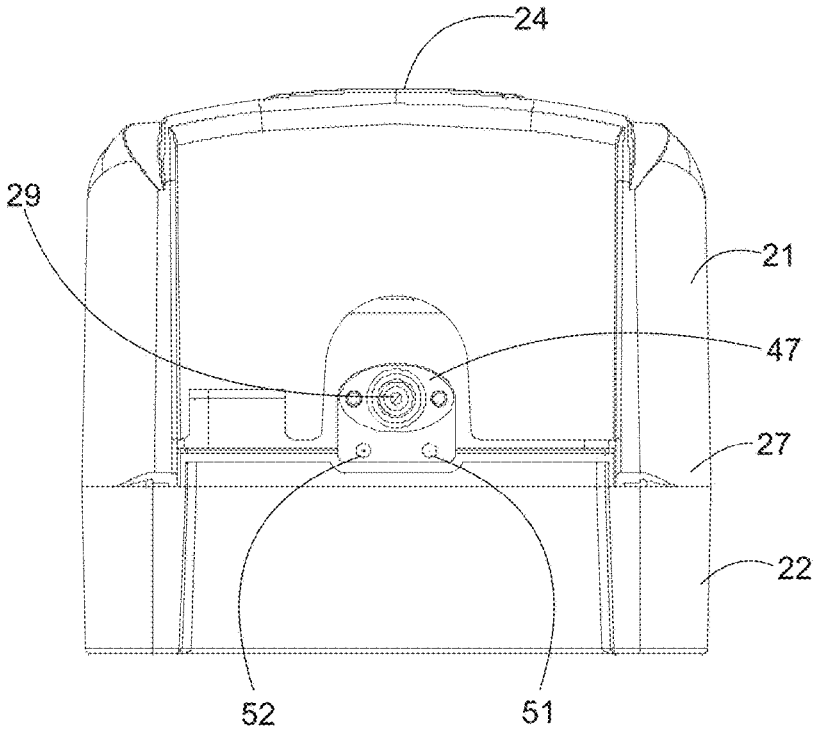
FIG. 5 is a bottom view of the wall mount dispenser.

As seen in FIGS. 4-5, a top view of the dispenser and a bottom view of the dispenser show that the key 11 is pressed onto the dispenser from a top portion adjacent to the base 22. A bottom view of the dispenser shows that the liquid outlet 29 is mounted to the nozzle 47. The nozzle may have a pair of screws that connect to the nozzle bracket 56 between the front cover 21 and the base 22. The first sensor 51 and the second sensor 52 are preferably mounted to the nozzle bracket 56 near and adjacent to the cover hinge 27.

Figure 6:
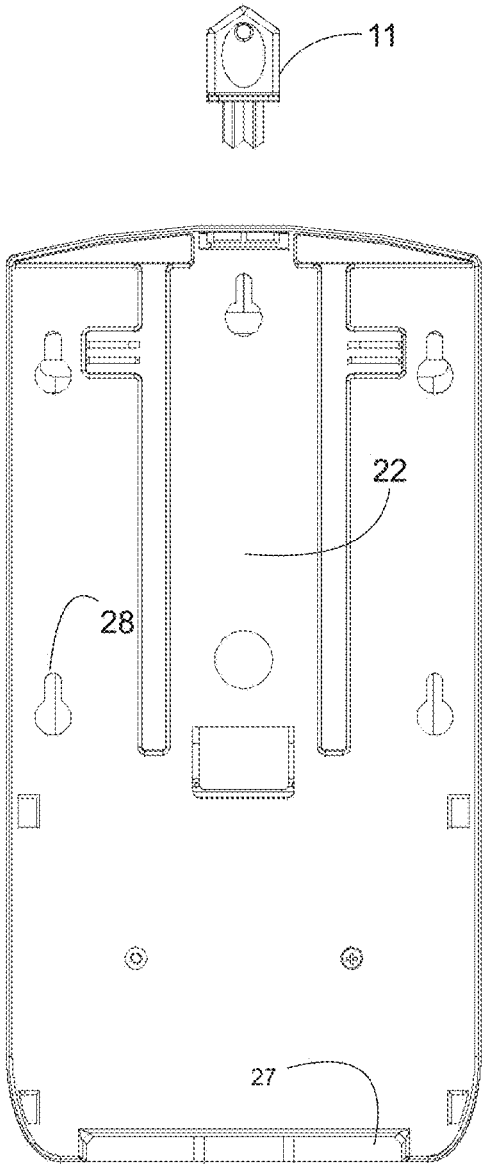
FIG. 6 is a rear view of the wall mount dispenser.
Figure 7:
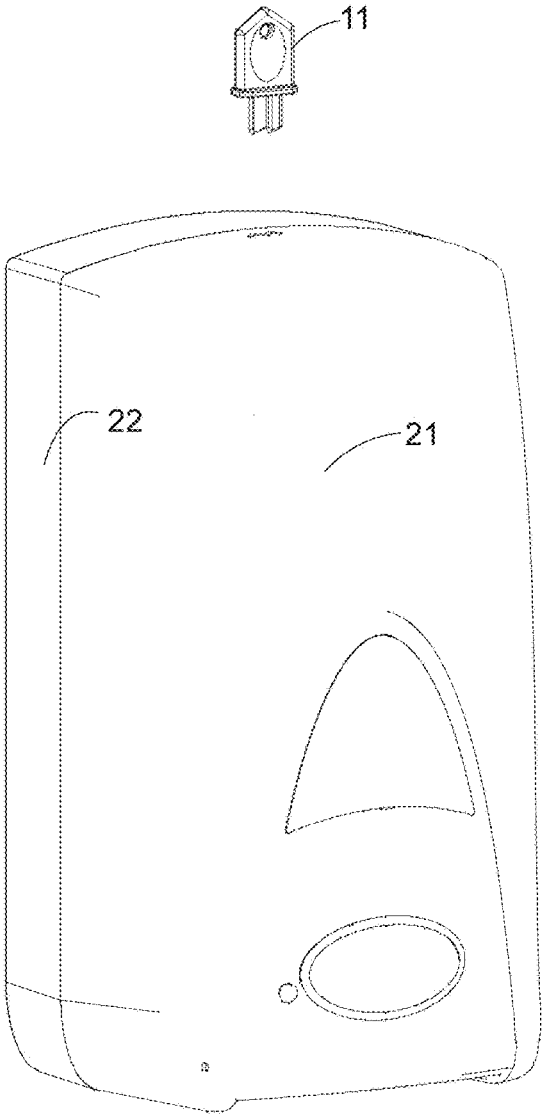
FIG. 7 is a perspective view of the wall mount dispenser.

As seen in FIGS. 6-7, the rear mount 28 can be formed on the base 22. The rear mount 28 can be formed of openings that can receive screws from the front side. The mount openings are preferably located in the upper portion of the base 22. Preferably, a middle top opening provides an initial anchor location which then allows the user to install four separate screws. In this way, the device is securely mounted to the wall. A perspective view of the present invention shows that the housing is generally a rounded rectangular prism shape.

Figure 8:
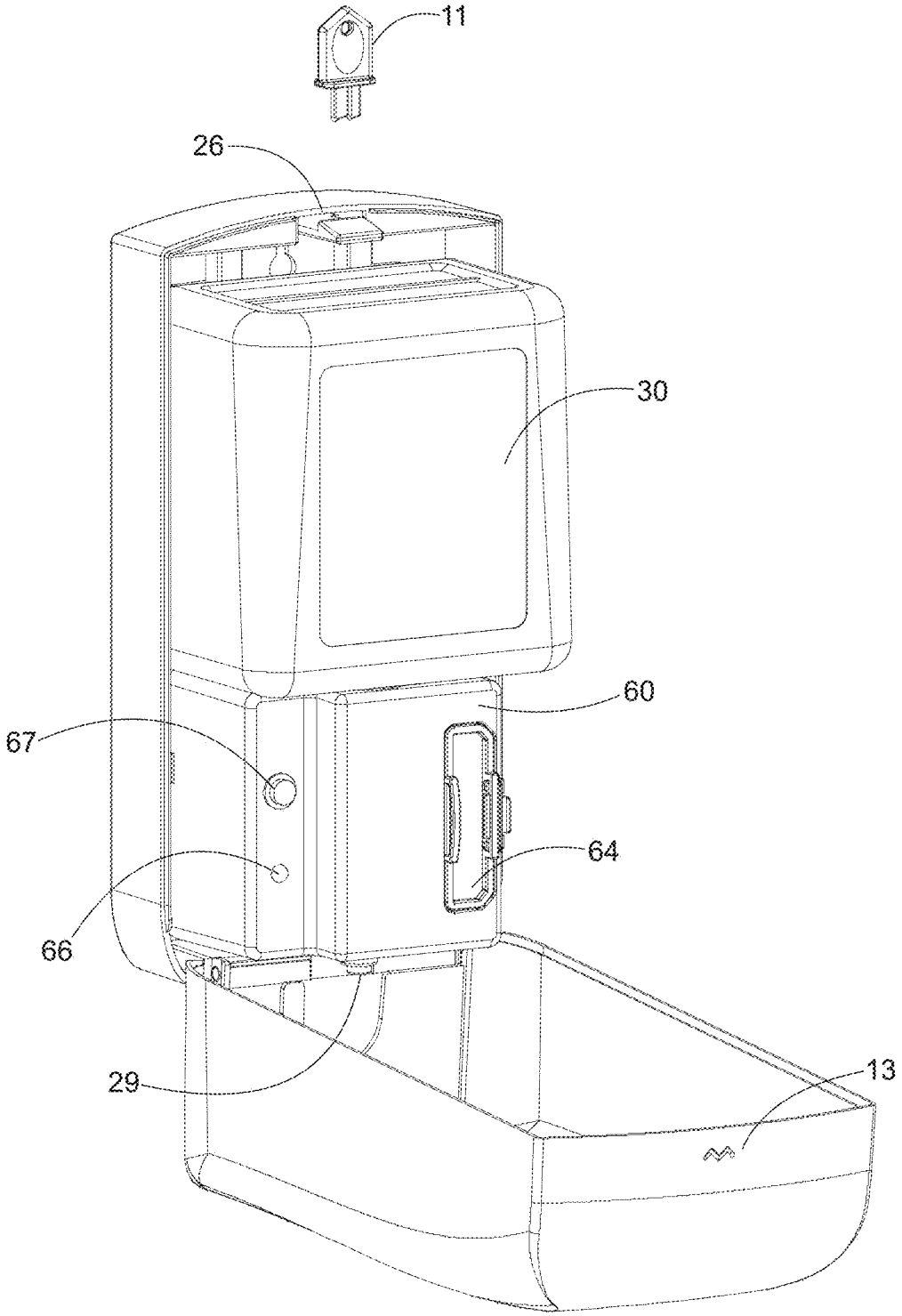
FIG. 8 is a perspective view of the dispenser with the cover open.

As seen in FIG. 8, the liquid container 30 sits on the pump housing 60. The pump housing 60 has a control button 67 for activating different functions. An indicator light 66 illuminates the indicator lens 25. A battery tray 64 allows the user to replace the batteries without removing the pump housing 60. Also, the liquid outlet 29 is exposed for cleaning when the key 11 opens the front cover latch 26. To replace the pump housing module 60, the user can remove the liquid container and 30, then press the base retainer 71 inwardly to slide out the pump housing module 60.

Figure 9:
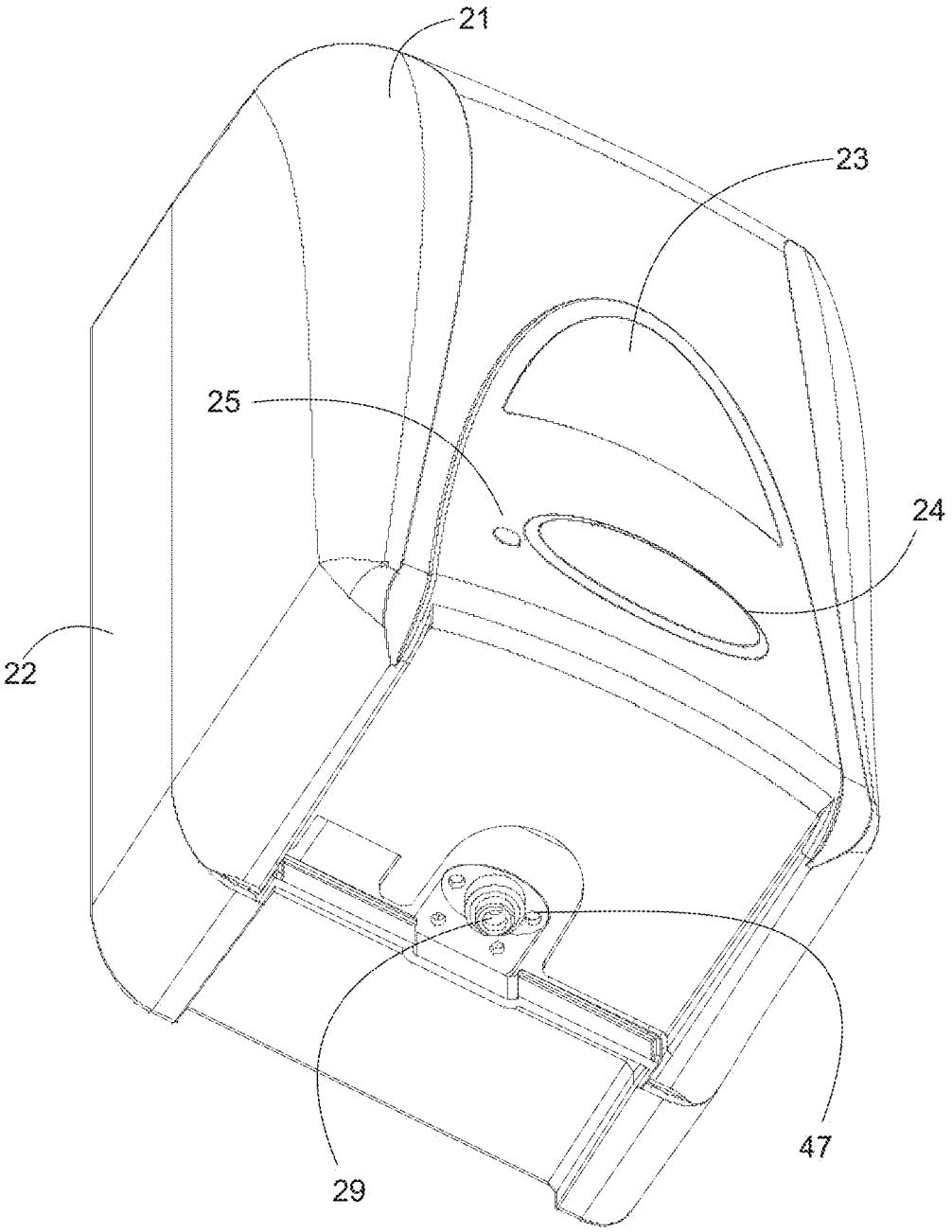
FIG. 9 is a bottom perspective view of the dispenser.

As seen in FIG. 9, the liquid outlet 29 is mounted to the nozzle 47 and has an unobstructed clearance in case the dispenser is dispensing foam.

Figure 10:
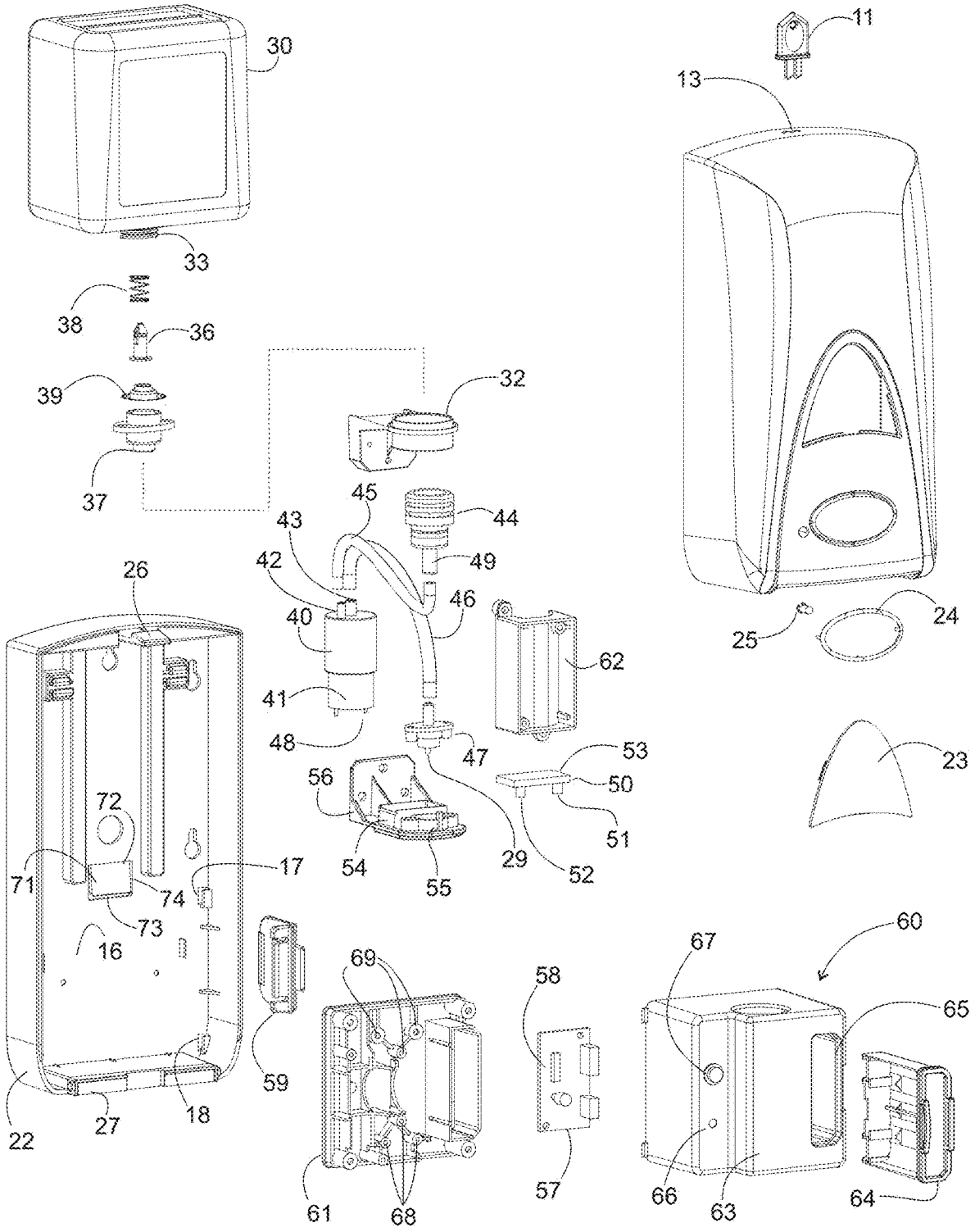
FIG. 10 is an exploded view of the dispenser.

As seen in FIG. 10, a detailed exploded view of the present invention shows all the major parts of the dispenser. The liquid container 30 has outlet threads 33. The outlet valve gate spring 38 biases the outlet valve gate 36 in a closed position against the outlet valve gate gasket 39. The container adapter 37 aligns the outlet valve gate 36 so that it is depressed to an open position when mounted to the bracket socket 44. The liquid container bracket 32 holds the bracket socket 44. The bracket socket 44 has a bracket socket tube connector 49 that connects the bracket socket 44 to the inlet tubing 45. The inlet tubing 45 connects to the pump 40 at an inlet pump nipple 42. The pump 40 has an inlet pump nipple 42 and an outlet pump nipple 43. The outlet pump nipple 43 is connected to the exit tubing 46. The exit tubing 46 is connected to the nozzle 47. The nozzle 47 has a liquid outlet 29 mounted to it.

The motor 41 in the pump 40 has motor electrical contacts 48. The motor electrical contacts are connected to the motherboard 57 and the controller 58. The controller 58 is configured to dispense liquid by activating the motor electrical contacts 48 when the controller 58 receives an input signal from the sensor assembly 50. The sensor assembly 50 is mounted in the nozzle mount 55. The nozzle mount 55 has a sensor board mount 54 which receives the sensor board 53. The sensor board mount 54 is formed as a slot with two small circular openings at the bottom of the slot. The first sensor 51 and the second sensor 52 peeks through the two small circular openings at the bottom of the slot. The sensor assembly 50 including the sensor board 53 is electrically connected to the motherboard 57 which has the controller 58.

The nozzle 47 also fits in a nozzle mount 55. The nozzle mount 55 is also formed as a slot with an opening at the bottom for the liquid outlet 29. The upwardly extending sidewalls of the nozzle mount 55 and the upwardly extending sidewalls of the sensor board mount 54 retain the nozzle is a rigid configuration to the first sensor 51 and the second sensor 52.

The pump bracket 62 can have a concave shape with a lower mounting opening and an upper left mounting opening for connecting and retaining the pump 42 the pump housing base 61. The pump housing base 61 has a lower bracket mount 68 and an upper bracket mount 69. Both the lower bracket mount and the upper bracket mount can be formed as integrally plastic injection molded screw studs for receiving three screws each in a triangular configuration. The indicator light 66 can be illuminated by an LED that is mounted to the motherboard 57.

The pump housing cover 63 fits with the pump housing base 61 to enclose the pump 40, tubing, pair of brackets and battery tray 64. The battery tray 64 fits into a battery tray opening 65. The battery tray opening 65 can have electrical contacts for transmitting electrical power to the controller 58. The pump housing 60 also has a round circular opening for the bracket socket 44.

Once the pump housing 60 is completely assembled with all of the parts, it becomes a modular unit. For repair and replacement, the pump housing module can fit onto a first socket retainer 17 and a second socket retainer 18. Optionally, a mounting bracket 59 can mount the pump housing 60 to the modular socket 16. The modular socket 60 is formed to receive the pump housing 60. As an added securing feature, the base retainer 71 formed as a base clip can be formed as a resilient plastic leaf spring that has a downwardly extending engaging edge that engages the pump housing 60 one the pump housing 60 snaps onto the plastic leaf spring downwardly extending engaging edge 73. For releasing the pump housing 60, a user can depress the base retainer 71. Thus, the pump housing 60 can be modularly removed and replaced without tools except for the key 11 which fits into the key opening 13.

The modular socket 16 further includes a base retainer 71 such as a base clip for retaining the pump housing. The base clip is formed as a leaf spring 72. The leaf spring has a lower engaging edge 73 that engages the pump housing along an engagement edge. The leaf spring 72 is configured to be snap engaged but then releasable when a user depresses the leaf spring. The base clip can be formed as a leaf spring 72 that is plastic injection molded and integrally formed with the base when the injected plastic is resilient and flexible. The leaf spring 72 can be mounted in a leaf spring slot 74 that is formed on the base 22.

The liquid container is preferably disposable. The liquid container is not connected to the pump. The liquid container is pumpless and provides foam liquid.

The invention claimed is:

1. A wall mounted dispenser comprising:

a. a base;

b. a rear mount formed on the base, wherein the rear mount is configured to attach to a wall;

c. a front cover, wherein the front cover is configured to fit over the base;

d. a modular socket, wherein the modular socket is formed in the base, wherein the modular socket includes a base clip configured to retain a pump housing;

e. a pump housing, wherein the pump housing is configured to fit in the modular socket as a module, and wherein the base clip comprises a resilient leaf spring integrally molded with the base and having a lower engaging edge that snap-engages a mating engagement edge of the pump housing to releasably retain the pump housing in the modular socket;

f. a pump powered by a motor, wherein the pump is mounted inside the pump housing;

g. a liquid container, wherein the liquid container has outlet threads that retain an outlet valve gate, wherein the outlet valve gate is mounted to a liquid container outlet opening, wherein the outlet valve gate controls liquid flow through the liquid container outlet opening, wherein an outlet valve gate spring biases the outlet valve gate to a closed position when the liquid container is removed, wherein an outlet valve gate gasket seals the outlet valve gate against the liquid container outlet opening;

h. a container adapter, wherein the container adapter aligns the outlet valve gate so that the outlet valve gate is depressed to an open position when mounted to a bracket socket;

i. a liquid container bracket retaining a bracket socket, wherein the liquid container bracket is mounted to the pump housing, wherein the pump is retained to the pump housing when the liquid container is removed, wherein the liquid container is pumpless;

j. a nozzle bracket retaining a nozzle, wherein the nozzle bracket is mounted to the pump housing, wherein the nozzle is connected to the pump by an exit tubing; and k. a liquid container removably connects to the bracket socket, wherein liquid in the liquid container flows through the bracket socket and then to an inlet tubing, wherein the inlet tubing is then connected to the pump.

2. The wall mounted dispenser of claim 1, wherein the base further includes a cover hinge, wherein the front cover is hinge mounted to the cover hinge, wherein the cover hinge is located at a lower edge of the base, wherein the cover hinge receives the front cover.

3. The wall mounted dispenser of claim 1, wherein the modular socket further includes a first socket retainer.

4. The wall mounted dispenser of claim 1, wherein the modular socket further includes a second socket retainer.

5. The wall mounted dispenser of claim 1, further including a battery tray opening formed on the pump housing, and further including a battery tray mounted to the battery tray opening.

6. The wall mounted dispenser of claim 1, further including a motherboard with a controller, wherein the controller is electrically connected to a first sensor and a second sensor, wherein the first sensor and the second sensor comprise a sensor assembly, wherein the sensor assembly is mounted to the nozzle bracket, wherein the sensor assembly is electrically connected to the controller wherein the sensor triggers operation of the motor.

7. The wall mounted dispenser of claim 1, wherein the modular socket further includes a base clip for retaining the pump housing.

8. The wall mounted dispenser of claim 7, wherein the base clip is formed as a leaf spring.

9. The wall mounted dispenser of claim 8, wherein the leaf spring has a lower engaging edge that engages the pump housing along an engagement edge.

10. The wall mounted dispenser of claim 9, wherein the leaf spring is configured to be snap engaged but then releasable when a user depresses the leaf spring.

11. The wall mounted dispenser of claim 10, wherein the base clip formed as a leaf spring is plastic injection molded integrally with the base.

12. The wall mounted dispenser of claim 11, wherein the base further includes a cover hinge, wherein the front cover is hinge mounted to the cover hinge, wherein the cover hinge is located at a lower edge of the base, wherein the cover hinge receives the front cover.

13. The wall mounted dispenser of claim 11, wherein the modular socket further includes a first socket retainer.

14. The wall mounted dispenser of claim 11, wherein the modular socket further includes a second socket retainer.

15. The wall mounted dispenser of claim 11, further including a battery tray opening formed on the pump housing, and further including a battery tray mounted to the battery tray opening.

16. The wall mounted dispenser of claim 11, further including a motherboard with a controller, wherein the controller is electrically connected to a first sensor and a second sensor, wherein the first sensor and the second sensor comprise a sensor assembly, wherein the sensor assembly is mounted to the nozzle bracket, wherein the sensor assembly is electrically connected to the controller wherein the sensor triggers operation of the motor.

* * * * *